United States Patent [19]

Leblanc

[11] Patent Number: 4,501,246

[45] Date of Patent: Feb. 26, 1985

[54] FUEL INJECTION PUMP

[75] Inventor: Jean Leblanc, Lyons, France

[73] Assignee: Robert Bosch GmbH, Stuttgart, Fed. Rep. of Germany

[21] Appl. No.: 397,712

[22] Filed: Jul. 13, 1982

[30] Foreign Application Priority Data

Jul. 22, 1981 [DE] Fed. Rep. of Germany ..... 3128975

[51] Int. Cl.[3] ..... F02M 39/00

[52] U.S. Cl. ..... 123/449; 123/458; 417/487; 417/519

[58] Field of Search ..... 417/487, 519, 221, 244, 417/253, 462, 505; 123/449, 450, 458, 502, 500, 506

[56] References Cited

U.S. PATENT DOCUMENTS

| | | | |
|---|---|---|---|
| 2,077,259 | 4/1937 | Planiol | 123/451 |
| 2,356,627 | 8/1944 | Skaredoff | 123/450 |
| 3,404,668 | 10/1968 | Eheim et al. | 123/449 |
| 3,598,507 | 8/1971 | Voit et al. | 417/505 |
| 4,073,275 | 2/1978 | Hofer et al. | 123/449 |
| 4,378,775 | 4/1983 | Straubel et al. | 123/458 |
| 4,382,751 | 5/1983 | Potter | 123/458 X |
| 4,385,610 | 5/1983 | Leblanc | 123/449 |
| 4,398,518 | 8/1983 | Leblanc et al. | 123/458 |
| 4,398,519 | 8/1983 | Tissot et al. | 123/449 |

FOREIGN PATENT DOCUMENTS

| | | | |
|---|---|---|---|
| 53-80803 | 7/1978 | Japan | 417/462 |

*Primary Examiner*—William L. Freeh
*Assistant Examiner*—Paul F. Neils
*Attorney, Agent, or Firm*—Edwin E. Greigg

[57] ABSTRACT

A fuel injection pump is proposed in which the fuel metering during the intake stroke of the pump pistons of the fuel injection pump is effected via a pressure conduit, the cross section of which is controlled first by an electrically controlled switching valve and second by means of the control of a fuel supply opening of the pressure conduit by means of a control groove, which communicates with the pump work chamber and, as part of a distributor shaft, is guided in synchronism with rpm. By means of the oblique disposition of the control groove and the possibility of an electrically controlled longitudinal displacement of the distributor shaft, the angular position at which injection takes place can be embodied in an arbitrary manner in combination with a switching valve.

5 Claims, 2 Drawing Figures

FUEL INJECTION PUMP

BACKGROUND OF THE INVENTION

The invention is based on a fuel injection pump of the type already known from the German patent 1 303 637, wherein a distributor is displaced axially by a mechanical rpm governor in order to determine fuel quantity, and is rotated relative to the drive shaft during its longitudinal displacement for the purpose of adjusting the injection onset. This relatively expensive means of regulation has the disadvantage that because of the rigid relationship between the regulation or control variables, adaptation to the requirements made by engine manufacturers, such as reducing noise, fuel consumption and toxic exhaust gas components, cannot now be made.

OBJECT AND SUMMARY OF THE INVENTION

The fuel injection pump according to the invention has the advantage over the prior art of providing the basis for an extremely flexible regulation of the injection pump. By embodying this concept, virtually all the requirements made by engine manufacturers while taking engine characteristics such as fuel consumption, temperature, exhaust gas, etc. into consideration can then be met. The effort required to attain this is relatively low and extremely flexible. By simultaneously controlling the control points of the control groove and of the switching valve serving the purpose of metering, it is advantageously possible to arrange the phases of fuel injection in an arbitrary manner and independently of rpm and injection quantity within the supply stroke range of the pump piston or pistons. The electrical adjusting apparatus provided for control and the electrical switching valve are not exposed to the injection pressure. By combining the switching valve and the control edges of the control groove, which are guided in synchronism with pump rpm, there are a great many opportunities for exerting influence on injection, while disadvantageous uncontrolled influence of the rpm on the fuel metering, such as is the case of fuel injection pumps controlled with magnetic valves because of the constant switching times, is substantially avoided.

The invention will be better understood and further objects and advantages thereof will become more apparent from the ensuing detailed description of preferred embodiments taken in conjunction with the drawings.

DESCRIPTION OF THE EXEMPLARY EMBODIMENT

Figure 1:
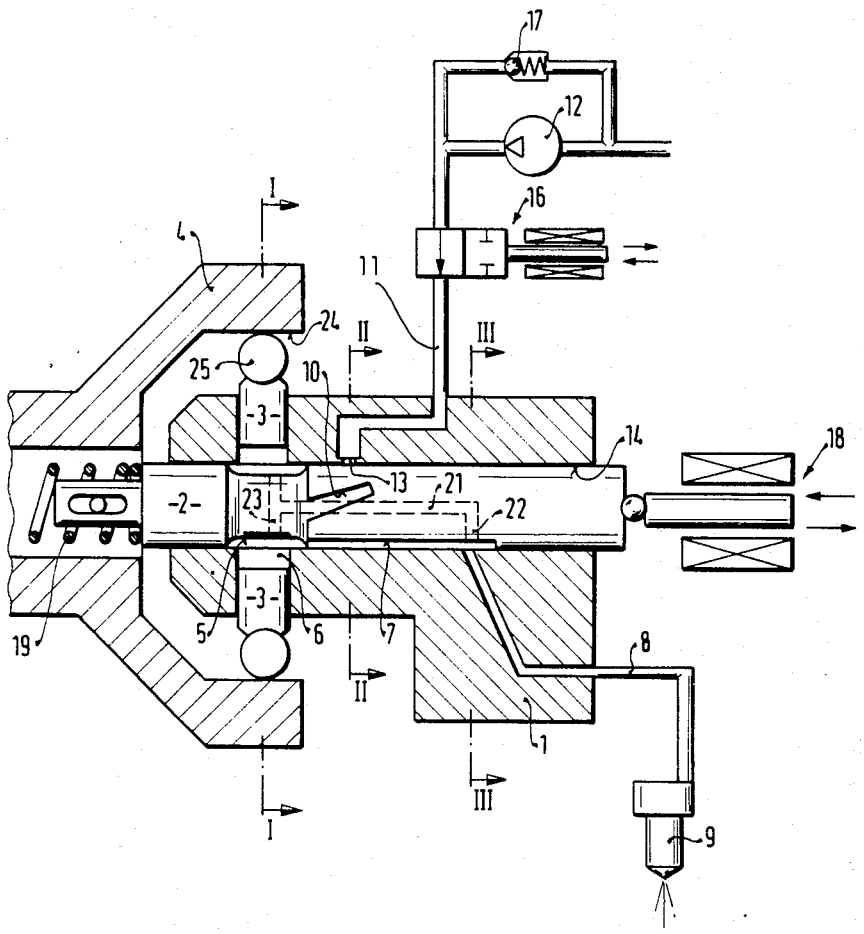
FIG. 1 shows a fuel injection pump according to the invention in longitudinal cross section.

In the housing 1 of a fuel injection pump, both a distributor shaft 2 and radially disposed pump pistons 3 are supported. The pump pistons 3 are driven via a cam ring 4, which surrounds the pistons in a cup-like manner and is firmly connected with the drive shaft (not shown) of the fuel injection pump. Via a coupling (not shown), the distributor shaft 2 is coupled in movement with the drive shaft, however, the distributor shaft 2 is axially displaceable in the housing 1. An annular groove 5 is disposed on the jacket face of the distributor shaft 2 and with the piston 3 defines the pump work chambers 6. Longitudinal grooves are connected with this annular groove 5, one longitudinal groove 7 cooperating as a distributor groove with the supply lines 8, which lead to the fuel injection nozzles 9 of the internal combustion engine and are opened up one after another by the distributor groove 7. The distributor groove may be embodied as a longitudinal groove which branches off from the annular groove 5, or it may be shorter in embodiment, being connected via a longitudinal conduit 21 and two radial conduits 22, 23 of the distributor shaft with the annular groove 5 (shown in broken lines in FIG. 1). Further disposed on the jacket face of the distributor shaft 2 are control grooves 10, which are connected with the annular groove 5 and extend slightly obliquely with respect to a jacket line of the distributor shaft 2. These control grooves 10 control a fuel supply opening 13, which discharges into the cylinder 14 guiding the distributor shaft 2 and represents the end of a pressure conduit 11 which is supplied with fuel by a fuel supply pump 12. An electrically actuatable switching valve 16 is disposed in the pressure conduit, and preferably, as a valve closing member, has a slide and is thus equalized in pressure. In particular, however, this valve should be of some type which is capable of performing rapid switching processes. The supply pressure of the fuel supply pump is held to a constant value with the aid of a pressure regulating valve 17.

As already noted, the distributor shaft 2 is longitudinally displaceable, which is effected with the aid of an electrical adjusting device 18. This device is shown only schematically in the drawing and acts upon the rotating distributor shaft via a point-like contact face. In the course of displacement of the distributor shaft counter to the force of a spring 19, the position of the control groove 10 relative to the fuel supply opening 13 varies, assuming a constant rotary position of the drive shaft, and thus the control time at which the fuel supply opening is opened varies as well.

Figure 2:
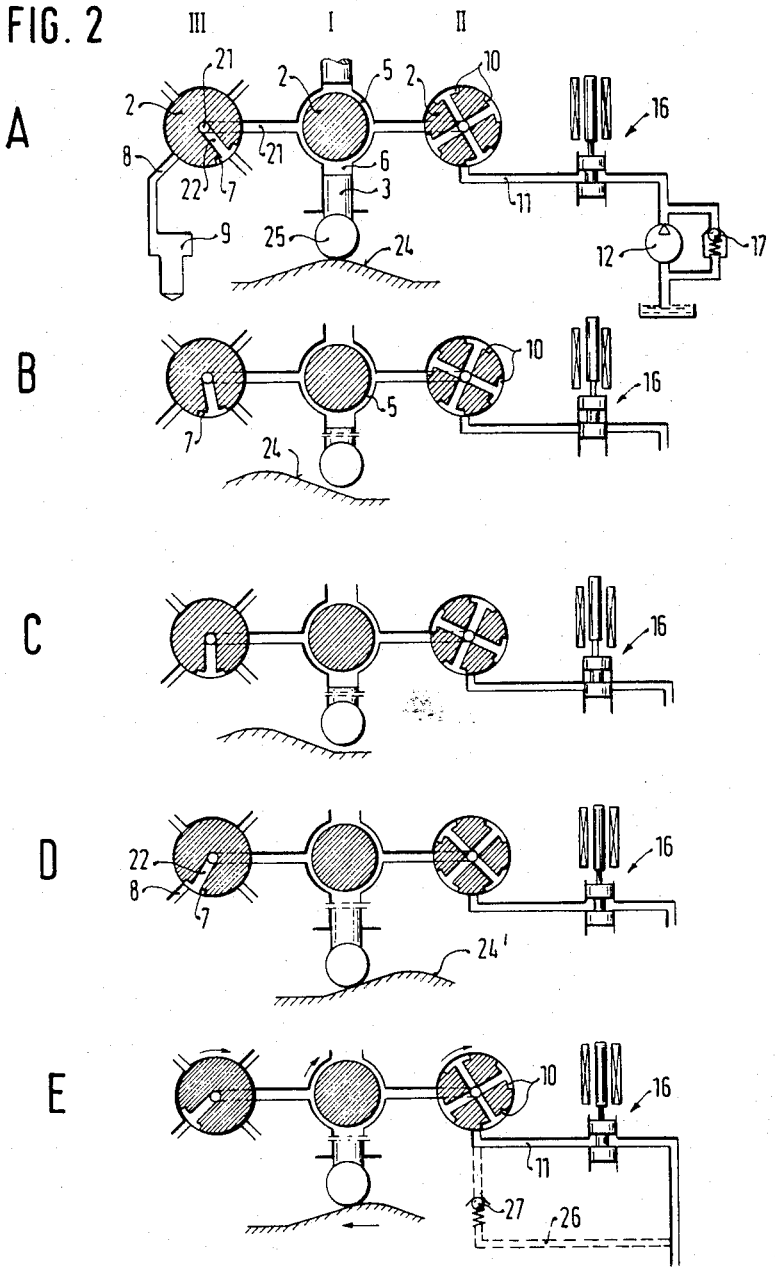
FIG. 2, in parts A, B, C, D and E, shows five different work positions, variously shown for the cross sections taken along the lines I, II and III of FIG. 1.

In order to better explain the function, five various rotational positions A, B, C, D and E are shown in FIG. 2, each of which, located schematically one beside the other, indicates the rotary positions in sectional planes I, II and III of the fuel injection pump of FIG. 1. Sectional plane I passes through the distributor shaft 2 in the vicinity of the pump pistons 3. The sectional plane II passes through the fuel supply opening 13, and the sectional plane III is located in the plane where the supply lines 8 discharge. In section I, a cam 24 of the cam ring 4 is also shown in its relationship with the pump piston 3, and a roller 25 is disposed in a known manner between the pump piston 3 and the cam 24.

FIG. 2A shows the rotary position of the distributor shaft 2 when the pump work chambers 6 are beginning to be filled with fuel. At this instant, the roller 25 has attained the highest point on the cam 24 and is about to pass along the downward edge of the cam. The pump piston is thereby moved outward and the pump work chamber 6 is enlarged. The switching valve 16 at this instant is located in the opened position, and the control groove 10 has just opened the connection with the pressure conduit 11. Thus fuel is capable of flowing via the control groove 10 into the annular groove 5 and from there into the pump work chambers 6. The fuel pressure assures that the rollers 25 remain pressed against the cam 24.

In FIG. 2B, the instant at which the switching valve 16 is closed, is shown. Although the control groove 10 is still in communication with the pressure conduit 11, the supply of fuel is stopped from this instant on, so that the pump pistons 3 maintain the position assumed at this instant and are not in contact with the cam. Thus, the end of fuel metering is attained.

In FIG. 2C, the communication between the control groove 10 and the pressure conduit 11 has been interrupted. From this instant on, the switching valve 16 can again be opened, so that there can be no loss in switching time resulting from the finite switching time of a magnetic valve and there can be no rpm influence on the fuel quantity caused by the switching time of a magnetic valve. The cam 24 has moved on relative to the pump piston or the roller 25, and the pump pistons 3 are still located in the position fixed in FIG. 2B.

In FIG. 2D, the next cam 24' has now reached the roller 25, which in the course of the further movement of the cam 24' causes the pump pistons 3 to move inward. The pump pistons 3 now execute the supply stroke and express the fuel via the longitudinal conduit 21 and the radial conduit 22 into the longitudinal groove 7, which is now in communication with one of the supply lines 8. The supplied fuel is pressed into this supply line and carried to the location of injection into the engine. The pressure conduit 11 continues to be blocked by the distributor shaft 2, and the switching valve 16 is opened.

FIG. 2E shows the end of injection, which is attained once the control groove 10 has been returned to communication with the pressure conduit 11. Although the distributor groove 7 remains in communication with the supply line 8, the supply of fuel is now interrupted, because the remaining fuel supplied by the pump piston 3 is capable of flowing out to the fuel supply side via the pressure conduit. In order to improve the shut-off of supply, a further conduit 26 can be provided which bypasses the switching valve 16 and includes a check valve 27. In this manner, the shutoff cross section is enlarged, and it is assured that the injection will be terminated abruptly. This final phase is then followed by phase A once again, and the process described above is repeated. As can be understood from this description, the fuel injection quantity per stroke can be determined solely by the switching valve 16. The metering phase is determined on the one hand by the opening of the pressure line 11 with a control edge of a control groove 10 guided in synchronism with rpm and on the other hand by the closure of the switching valve 16. Thus, the influence of rpm on fuel metering comes into effect only once, because of the constant switching time of the switching valve 16. This manner of control, given a variable injection quantity, produces variable injection onset times. In contrast to this, it is possible to keep the end of injection constant.

Another control possibility is the metering of a uniformly large fuel quantity continuously via the switching valve 16, as a result of which a constant injection time is attained; in order to vary the fuel injection quantity, the distributor shaft 2 is displaced. As a result of this displacement, the point at which the control groove again communicates with the pressure line 11 at the end of the injection phase is also varied. The location of the end of injection is thus variable. This manner of control has the further advantage that fuel metering is not dependent on the switching times of the switching valve. By combining both the displacement of the distributor shaft and variable opening times of the switching valve 16, it is possible for an arbitrary fuel quantity to come to the point of injection within an arbitrary range of the possible supply stroke of the pump pistons 3. With an appropriately embodied control device, arbitrary injection times and injection durations camn be attained in accordance with temperature, load, rpm and other engine parameters.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A fuel injection pump having at least one pump work chamber enclosed in a cylinder by at least one pump piston, which is actuated by cam means in synchronism and constant relation to drive means of said injection pump, said pump work chamber being in continuous communication with a distributor opening in an axially displaceable distributor shaft which is rotated by said drive means in synchronism therewith within a cylinder and is capable of being connected thereby with one of a series of supply lines distributed over the circumference of said cylinder which lead from said cylinder to a fuel injection point, said point being effected in sequence during the supply stroke of said pump piston, further wherein said pump work chamber is in continuous communication with a control groove in a jacket face of said distributor shaft, with control groove arranged to cooperate with a fuel inlet opening which discharges into said cylinder and wherein the rotary and axial position of a part of said control groove that coacts with said fuel inlet opening relative to said drive means is variable by an axial displacement of said distributor shaft characterized in that said fuel inlet opening is arranged to communicate via an electrically actuatable switching valve with a fuel supply source such that the switching valve is opened after the fuel inlet opening has been closed by a trailing limiting edge of said control groove, and said switching valve is closed at variable points of rotation of the distributor after a leading control edge of said control groove has again opened the fuel inlet opening and a desired amount of fuel has been admitted through said control groove, thereby changing in cooperation with the relative rotary position of said control edge of said control groove the instant and quantity of the fuel to be injected and further that said distributor shaft is axially displaceable by means of an electrical adjusting device for changing that relative rotary position of the control groove.

2. A fuel injection pump as defined by claim 1, characterized in that the pressure of the fuel supply source can be adjusted such that it is constant by means of a pressure regulator.

3. A fuel injection pump as defined by claim 1, characterized in that said control groove is arranged at an angle relative to the axial direction of the distributor shaft.

4. A fuel injection pump as defined by claim 1, characterized in that said switching drive further includes a slide member.

5. A fuel injection pump as defined by claim 1, characterized in that said switching valve further includes a relief line which includes a check valve arranged to open toward said fuel supply source.

* * * * *